US010022733B2

(12) United States Patent
Richardson

(10) Patent No.: US 10,022,733 B2
(45) Date of Patent: Jul. 17, 2018

(54) MICROFLUIDIC LAMINAR FLOW NOZZLE APPARATUSES

(71) Applicant: Imagine TF, LLC, Los Gatos, CA (US)

(72) Inventor: Brian Edward Richardson, Los Gatos, CA (US)

(73) Assignee: IMAGINE TF, LLC, Los Gatos, CA (US)

( * ) Notice: Subject to any disclaimer, the term of this patent is extended or adjusted under 35 U.S.C. 154(b) by 14 days.

(21) Appl. No.: 15/346,297

(22) Filed: Nov. 8, 2016

(65) Prior Publication Data

US 2017/0128961 A1 May 11, 2017

Related U.S. Application Data

(60) Provisional application No. 62/285,836, filed on Nov. 10, 2015.

(51) Int. Cl.

| | |
|---|---|
| ***B05B 1/18*** | (2006.01) |
| ***B05B 7/04*** | (2006.01) |
| ***B05B 7/14*** | (2006.01) |
| ***B05B 17/06*** | (2006.01) |

(52) U.S. Cl.

CPC ..... *B05B 1/185* (2013.01); *B05B 7/04* (2013.01); *B05B 7/1481* (2013.01); *B05B 17/06* (2013.01)

(58) Field of Classification Search

CPC ..... B05B 1/185; B05B 7/04; B05B 7/1481; B05B 17/06

See application file for complete search history.

(56) References Cited

U.S. PATENT DOCUMENTS

| | | | | |
|---|---|---|---|---|
| 3,473,530 | A * | 10/1969 | Urbanowicz | A61M 11/06 222/199 |
| 4,262,371 | A * | 4/1981 | Berry | A61H 33/027 239/420 |
| 4,282,533 | A * | 8/1981 | Brooks | B41J 2/162 347/47 |
| 6,817,550 | B2 * | 11/2004 | Taylor | B05B 1/00 239/19 |
| 7,861,944 | B2 * | 1/2011 | Yen | B05B 17/06 239/102.1 |
| 8,562,785 | B2 * | 10/2013 | Kang | H01J 37/3244 |
| 9,056,322 | B1 * | 6/2015 | Williams | B05B 1/20 |
| 2003/0143328 | A1 * | 7/2003 | Chen | C23C 16/06 427/255.28 |
| 2006/0162661 | A1 * | 7/2006 | Jung | C23C 16/345 118/723 ER |
| 2013/0135392 | A1 * | 5/2013 | Kang | B41J 2/14209 347/47 |
| 2014/0307036 | A1 * | 10/2014 | Xie | B41J 2/14008 347/94 |

* cited by examiner

*Primary Examiner* — Steven J Ganey
*Assistant Examiner* — Steven M Cernoch
(74) *Attorney, Agent, or Firm* — AMPACC Law Group, LLP; Keith Kline

(57) ABSTRACT

Microfluidic laminar flow nozzle apparatuses are described herein. An example apparatus includes a base having a sidewall that forms a lower plenum chamber, and a micro-fluidic nozzle panel disposed above the base to enclose the lower plenum chamber, the micro-fluidic nozzle panel including a plurality of micro-fluidic nozzles, each of the plurality of micro-fluidic nozzles having a fluid output orifice for outputting a fluid.

10 Claims, 16 Drawing Sheets

MICROFLUIDIC LAMINAR FLOW NOZZLE APPARATUSES

CROSS REFERENCE TO RELATED APPLICATIONS

The application claims the benefit and priority of U.S. Provisional Application Ser. No. 62/285,836, filed on Nov. 10, 2015, which is incorporated by reference herein in its entirety, including all references and appendices cited therein.

FIELD OF THE PRESENT TECHNOLOGY

The present technology relates generally to fluid nozzle apparatuses, and more particularly, but not by limitation, to micro-fluidic nozzle apparatuses that include one or more micro-fluidic nozzle panels having a plurality of micro-fluidic nozzles that deliver a fluid that transfers in laminar or streamlined flow.

SUMMARY

According to some embodiments, the present disclosure is directed to a micro-fluidic nozzle apparatus, comprising: (a) a base comprising a sidewall that forms a lower plenum chamber; and (b) a micro-fluidic nozzle panel disposed above the base to enclose the lower plenum chamber, the micro-fluidic nozzle panel comprising a plurality of micro-fluidic nozzles, each of the plurality of micro-fluidic nozzles comprising a fluid output orifice for outputting a fluid.

According to some embodiments, the present disclosure is directed to a micro-fluidic nozzle apparatus, comprising: (a) a base comprising a sidewall that forms a lower plenum chamber; (b) a first micro-fluidic nozzle panel disposed above the base to enclose the lower plenum chamber, the first micro-fluidic nozzle panel comprising a first plurality of conical micro-fluidic nozzles, each of the first plurality of conical micro-fluidic nozzles comprising a fluid output orifice for outputting a fluid; (c) a first spacer plenum riser that surrounds around a periphery of the first micro-fluidic nozzle panel; and (d) an orifice plate that comprises a plurality of apertures that align with the first plurality of conical micro-fluidic nozzles, the orifice plate mounted to the spacer plenum riser to form a riser plenum chamber.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DETAILED DESCRIPTION OF EXEMPLARY EMBODIMENTS

Figure 1:
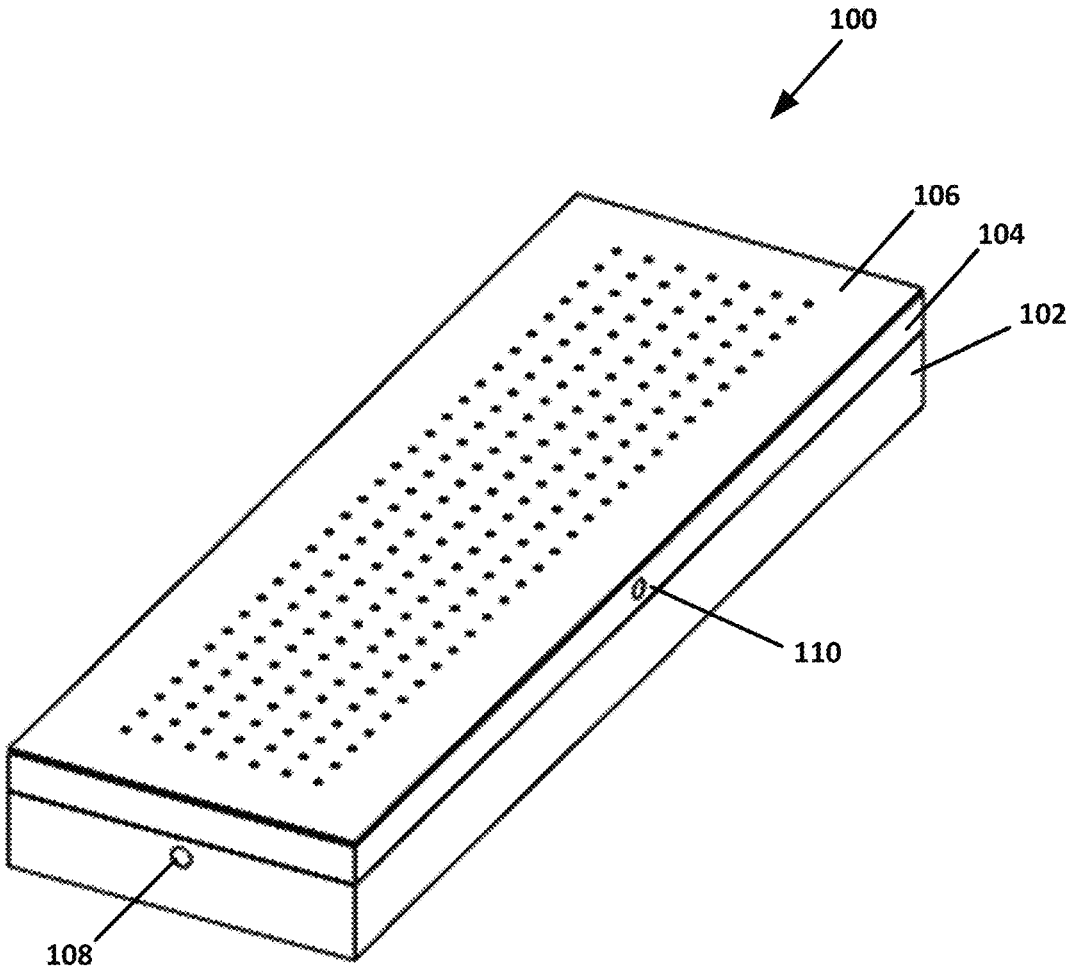
FIG. 1 is a perspective view of an example micro-fluidic nozzle apparatus, constructed in accordance with the present disclosure.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

It is often desirable to atomize fluids or fluids having suspended solids. For example: application of paint or other fluids to a surface, dispensing of a liquid in particle form, the dispensing of a liquid with particles; each benefit from atomization of fluids. With most of these applications, it is common to have only one, or a few, atomizing nozzles. To deliver or process any significant quantity of fluid, high pressure is often required. With high pressure and high flow rates, the flow in and around the nozzle is turbulent type flow. Turbulent flow makes the control of atomization of the fluid difficult.

The present disclosure provides micro-fluidic nozzle apparatuses that are capable of provide varying degrees (e.g., low to high) of volumetric fluid flow without producing turbulence within the fluid. The micro-fluidic nozzle apparatuses deliver fluid(s) having a laminar flow type.

FIG. 1 illustrates an example micro-fluidic nozzle apparatus (hereinafter apparatus 100) that comprises a base 102, riser 104, and orifice plate 106. A first input or interface 108 is provided in the base 102, and a second input or interface 110 is provided in the riser 104. In one aspect, the input 108 receives fluid to be atomized and supplies a first fluid to a lower plenum chamber (see FIG. 2). The second input 110 supplies a second fluid to a riser plenum chamber (see FIG. 2). This second fluid is used to create a laminar bed of air exiting the apertures (e.g., annular rings) of the orifice plate 106, as will be discussed below.

One of ordinary skill in the art will appreciate that metals, plastics, ceramics, and or many other materials could be used in the fabrication of the micro-fluidic nozzle apparatus components. Nickel is utilized in some embodiments for fabrication of micro-fluidic nozzle panels, as will be discussed below. Electroplating nickel is a cost effective way to manufacture this type of part from a tool.

Figure 2:
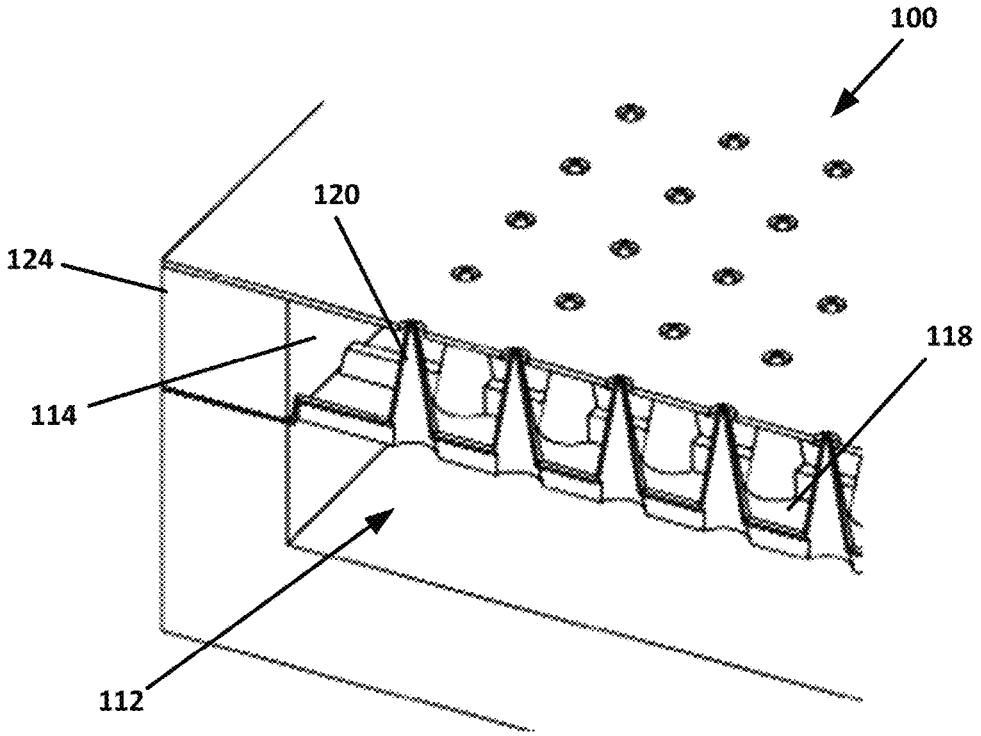
FIG. 2 is a cross sectional, perspective view of the micro-fluidic nozzle apparatus.
Figure 3:
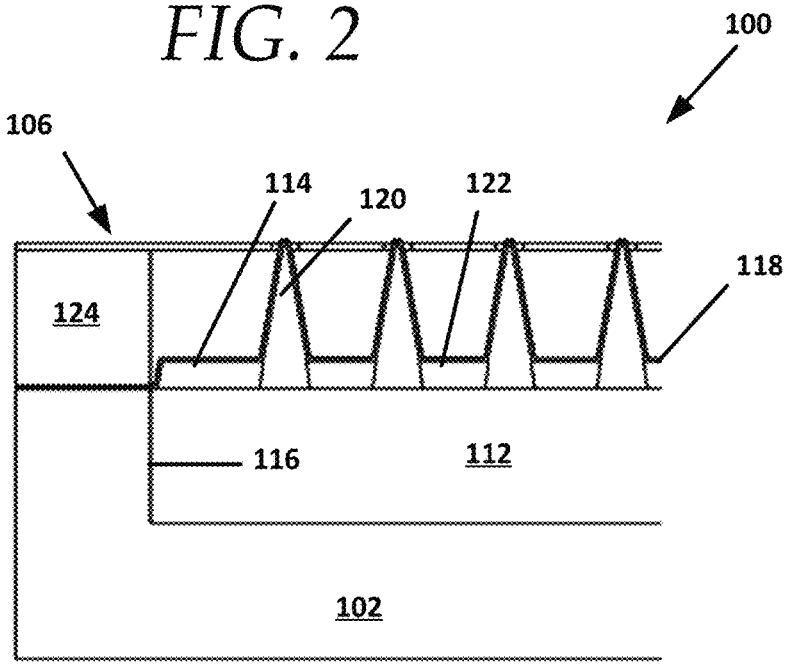
FIG. 3 is a cross sectional, end view of the micro-fluidic nozzle apparatus.
Figure 4:
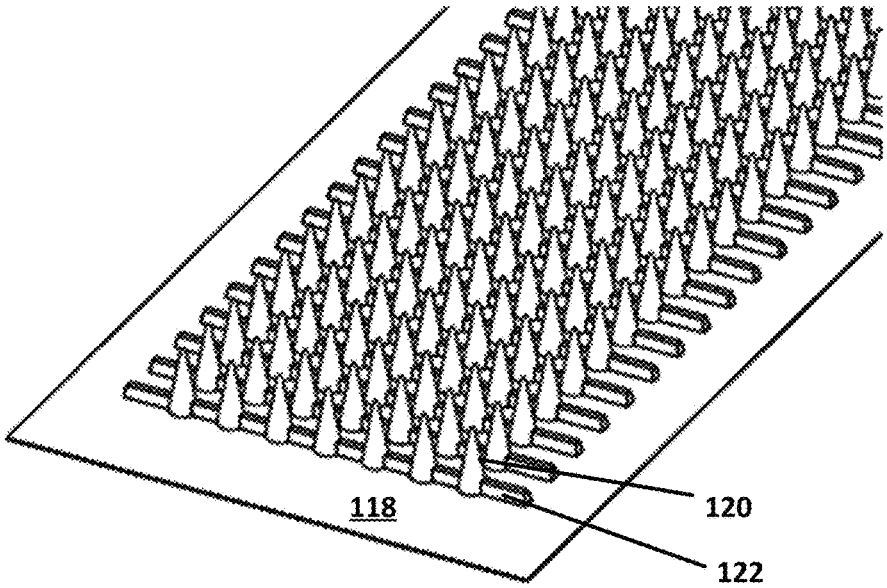
FIG. 4 is a perspective view of an example micro-fluidic nozzle panel.
Figure 5:
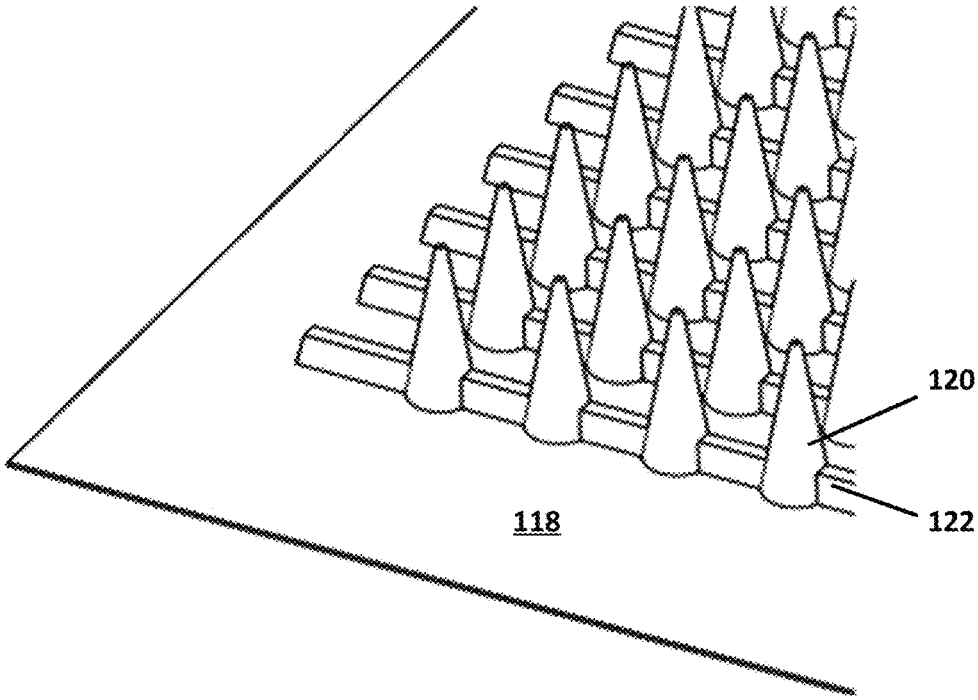
FIG. 5 is a close up perspective view of a corner of the micro-fluidic nozzle panel.

FIGS. 2 and 3 collectively illustrate the lower plenum chamber 112 and riser plenum chamber 114. A periphery of the lower plenum chamber 112 is created by a sidewall 116 of the base 102. A micro-fluidic nozzle panel 118 separates the lower plenum chamber 112 and riser plenum chamber 114.

The micro-fluidic nozzle panel 118 encloses the lower plenum chamber 112 and provides a lower bounding surface for the riser plenum chamber 114.

Referring now to FIGS. 2-5 collectively, the micro-fluidic nozzle panel 118 comprises a plurality of micro-fluidic nozzles, such as micro-fluidic nozzle 120. The plurality of micro-fluidic nozzles are arranged into rows with individual rows comprising micro-fluidic nozzles that are spaced apart from one another. The spacing of the micro-fluidic nozzles is a matter of design choice, specifically based on a desired fluid output volume for the apparatus 100.

The micro-fluidic nozzles of a row are linked with cross ribs, such as cross rib 122. The cross ribs increase structural strength of micro-fluidic nozzle panel 118 and reduce deflection caused by a pressure differential between the lower plenum chamber 112 and riser plenum chamber 114.

While some embodiments include rows of micro-fluidic nozzles, the micro-fluidic nozzles can be arranged in any pattern (e.g., arrangement and/or inter-nozzle spacing) desired.

It will be understood that the lower plenum chamber 112 supplies micro-fluidic nozzles of the micro-fluidic nozzle panel 118 with a single input from the input 108. By supplying the lower plenum chamber 112 with one input all of the fluid pressures at the micro-fluidic nozzles are substantially equal. To achieve this effect with conventional systems, regulators would most likely be required.

A riser 124 is placed on a periphery of the micro-fluidic nozzle panel 118 and the orifice plate 106 is placed onto the riser 124 to enclose the riser plenum chamber 114. The riser plenum chamber 114 receives fluid from the input 110 (see FIG. 1).

Figure 6:
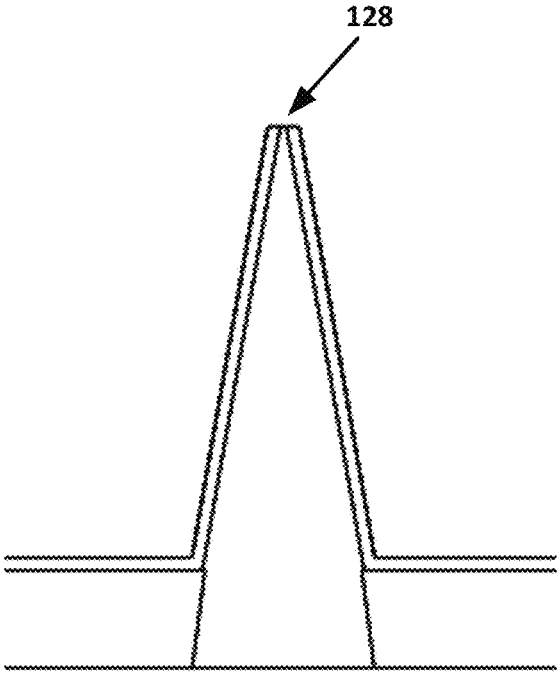
FIG. 6 is a cross sectional view of a single micro-fluidic nozzle.

In FIG. 6 a section view of one micro-fluidic nozzle 120 is shown. Fluid flows from the rear plenum area through the riser and out of the fluid output orifice 128. Flow throughout this path is primarily laminar in nature. Laminar flow is a function of the fluid properties, mechanical dimensions and the fluid velocities. By engineering these parameters, laminar flow can be maintained as would be appreciated by one of ordinary skill in the art. For example, atomized droplet size and flow volume are selectable parameters that are adjustable to produce a desired laminar flow type. Nozzle outlet diameter affects a droplet size while velocity through the plenum chambers affects flow rates through nozzle outlets and orifices.

Figure 7:
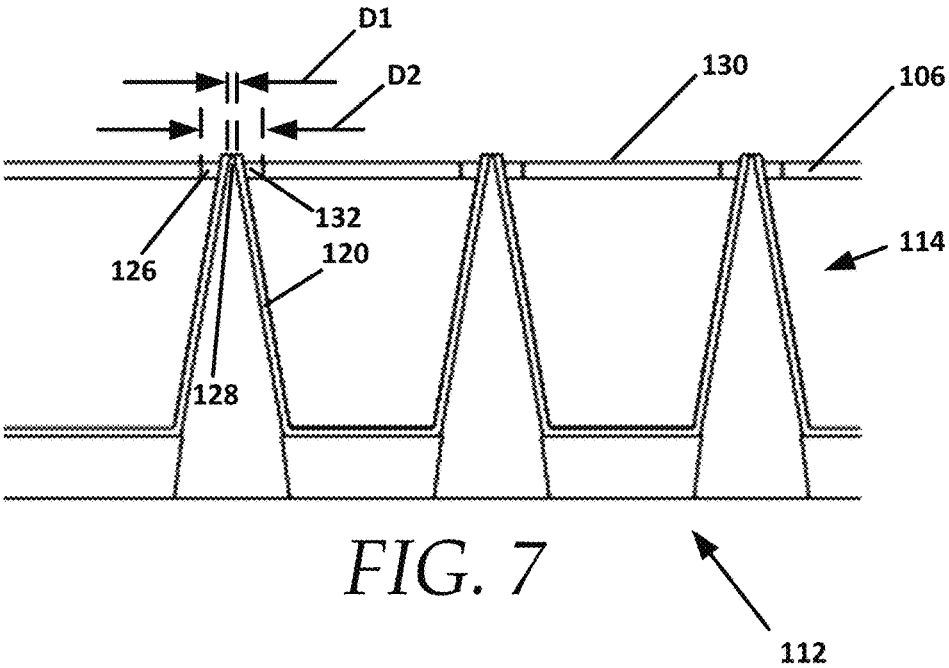
FIG. 7 is a cross sectional view of a plurality of micro-fluidic nozzles in association with an orifice plate.

In FIG. 7 the orifice plate 106 comprises a plurality of apertures, such as aperture 126. The aperture 126 is placed into alignment with the micro-fluidic nozzle 120. A fluid output orifice 128 of the micro-fluidic nozzle 120 extends above an upper surface 130 of the orifice plate 106. The aperture 126 has a diameter D1 that is greater than a diameter D2 of the fluid output orifice 128 of the aperture 126 which forms an annular ring 132. Fluid within the riser plenum chamber 114 will exit from the annular rings while fluid within the lower plenum chamber 112 will exit the fluid output orifice of the micro-fluidic nozzles.

Figure 8:
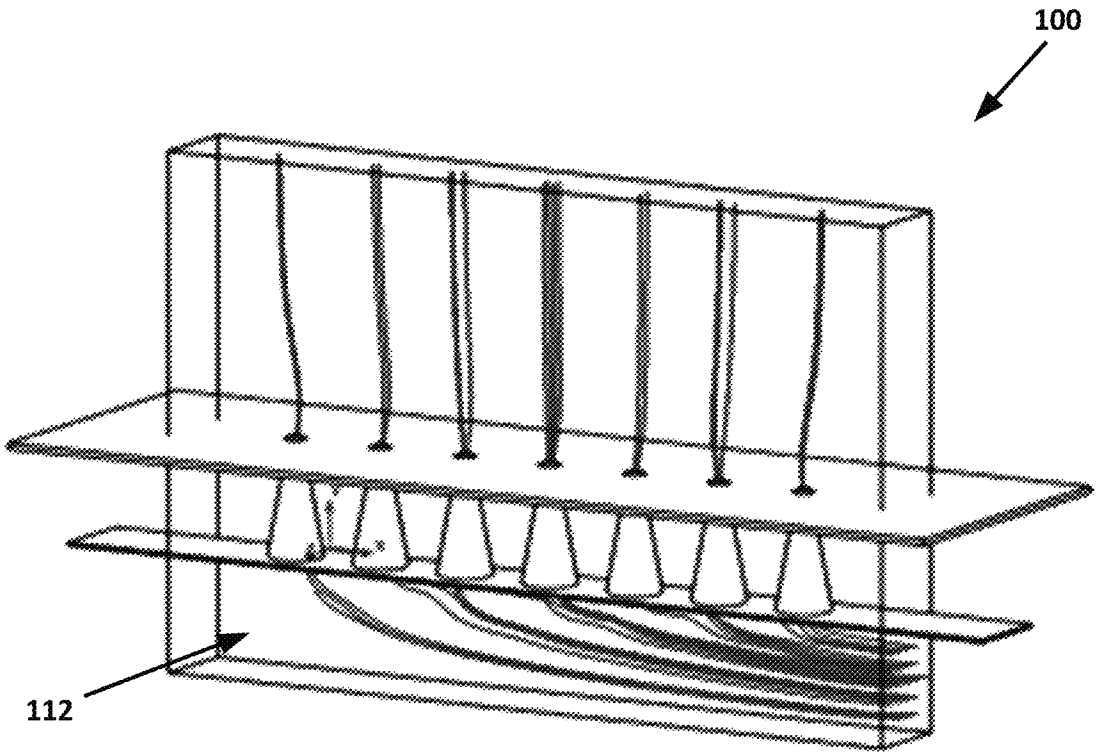
FIG. 8 is a perspective view of a flow of fluid into a lower plenum chamber of the micro-fluidic nozzle apparatus and laminar flow of the fluid being output by a plurality of micro-fluidic nozzles.

FIG. 8 illustrates fluid flow through the lower plenum chamber 112 into the micro-fluidic nozzles and out from the fluid output orifices of the micro-fluidic nozzles in a laminar flow.

Figure 9:
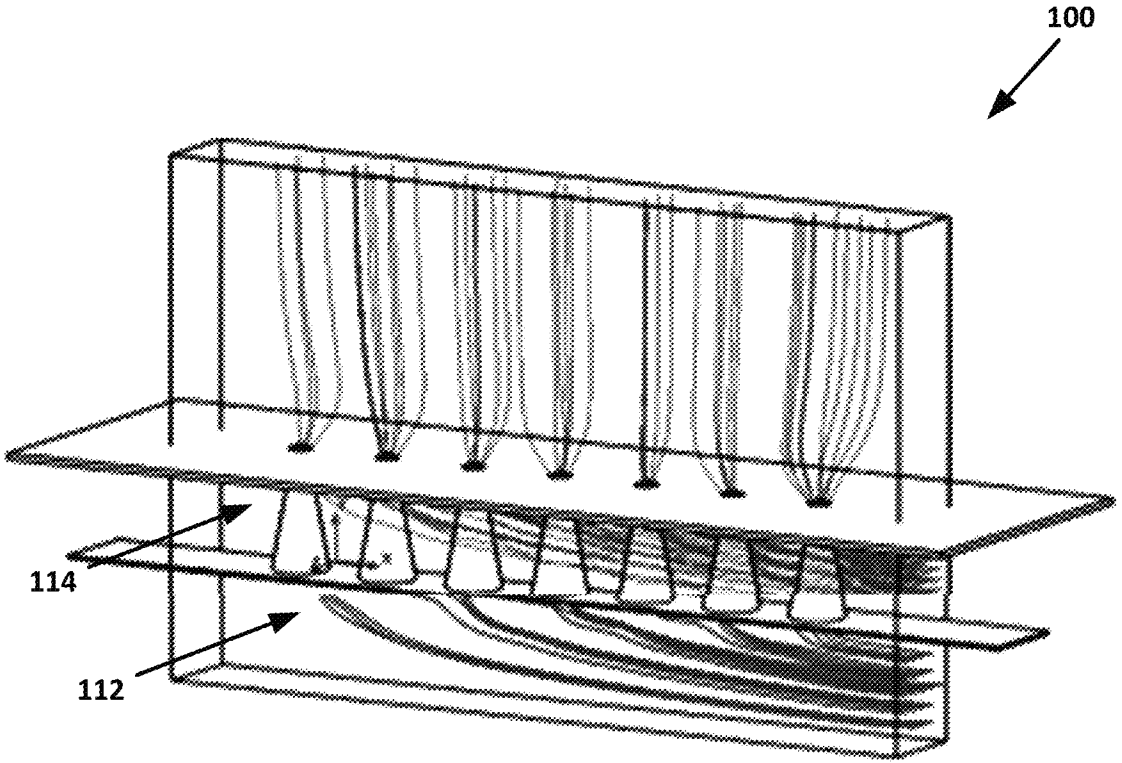
FIG. 9 is a perspective view of a flow of fluid into a riser plenum chamber of the micro-fluidic nozzle apparatus and laminar flow of the fluid being output from annular rings surrounding the plurality of micro-fluidic nozzles.

FIG. 9 illustrates fluid flow through the riser plenum chamber 114 and out from the annular rings formed by the apertures of the orifice plate and the micro-fluidic nozzle, in addition to the flow illustrated in FIG. 8 through the lower plenum chamber 112. The fluid flow has a laminar flow type, which prevents fluid exiting the annular rings from mixing with fluid exiting the micro-fluidic nozzles, which would occur if either or both of the fluid flows were turbulent flow. Laminar flow forms one controlled droplet at a time (not broken up into small droplets). They are more controlled in size.

Fluid pressure within each of the plenums can be controlled by nozzle diameter (e.g., diameter of fluid output orifices) and/or flowrate of the fluid. This can be used to control a phase of the fluids either inside the plenums or when the fluid exits the apparatus 100.

Figure 10:
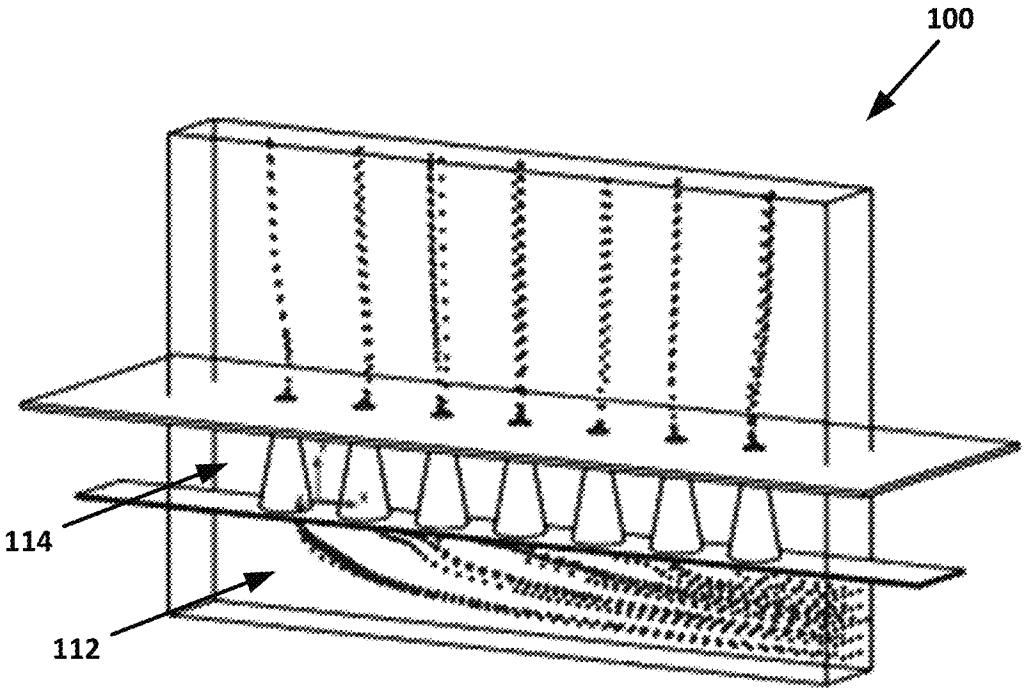
FIG. 10 illustrates the output of particle bearing fluid from the micro-fluidic nozzle apparatus.

FIG. 10 illustrates the fluid flow through the lower plenum chamber 112 into the micro-fluidic nozzles and out from the fluid output orifices of the micro-fluidic nozzles in a laminar flow. The fluid in this instance includes a fluid bearing a particulate such as organic or plastic particles.

It will be understood that the fluid that is delivered to the lower plenum chamber 112 would more than likely be a different fluid type from the fluid that is delivered to the riser plenum chamber 114.

The fluid flow from either the annular rings or the fluid output orifices can be a continuous flow or most often droplets could be formed at the orifices/rings, the surface tension of the two fluids effects droplet formation. The flow rate would be engineered for the specific task of the apparatus 100.

In some instances, a temperature of either fluid (fluid in lower or riser plenum) can be controlled to the function of the apparatus 100. In a first example, pressure within the lower plenum chamber 112 can be designed so that hot water remains liquid within the lower plenum chamber 112. When the water exits the micro-fluidic nozzles the pressure lowers. This lower pressure would promote vaporization. Liquid from the riser plenum chamber 114 could be used to enhance or retard the vaporization.

In another example, a fluid with particles within the lower plenum chamber 112 could be separated from the particles by elevating a temperature of the fluid and particles and at the lower plenum chamber 112. When the fluid and particles exit the micro-fluidic nozzles the water would vaporize more freely. Having the riser plenum chamber 114 supplied with hot air would further promote vaporization of water and therefore dry the particles.

One of ordinary skill in the art will appreciate that any number of combinations of fluids, flow rates pressures, nozzle and/or annular ring diameters, and temperatures or fluid phases can be used to create many suitable processes with the disclosed apparatus.

A secondary fluid in the riser plenum chamber 114 can be at an elevated temperature to cause some or all of a liquid as the primary fluid in the lower plenum chamber 112 to vaporize as it exits the fluid output orifices.

Conversely, fluid exiting all or part of the atomizing system could be at a low enough temperature that vapor in a gas would condense on the surface of the atomized fluid. A secondary fluid exiting the riser plenum chamber 114 can be at a reduced temperature to cause all or some of the liquid exiting the lower plenum chamber 112 to solidify.

Liquid or solids created by the microfluidic nozzles can be combined with a third fluid (liquid or gas) after they exit the nozzle system.

Figure 11:
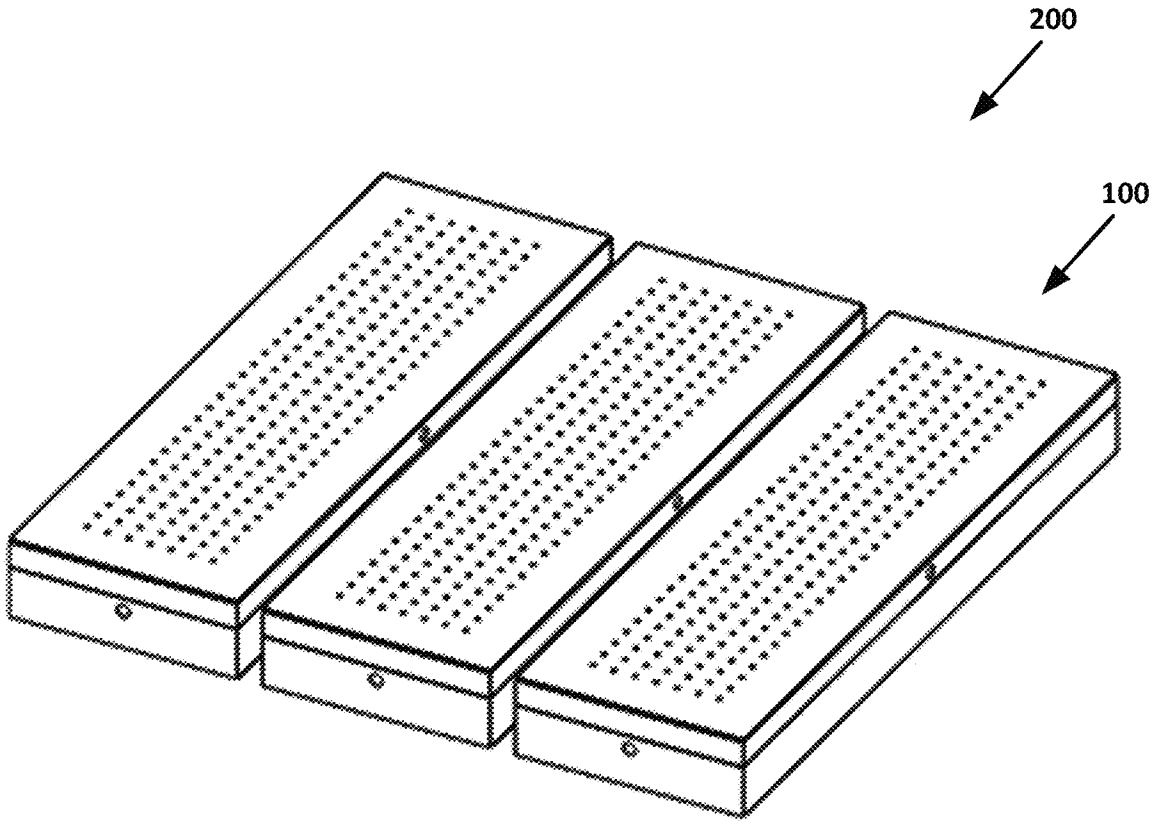
FIG. 11 illustrates an array of micro-fluidic nozzle apparatuses.

FIG. 11 illustrates an array 200 that comprises a plurality of apparatuses, such as apparatus 100. To increase capacity, arrays of atomizing apparatuses can be configured to meet the needs of the process. A number of nozzles with each atomizing apparatus could be increased or decreased depending on the process requirements. To maintain laminar flow with an apparatus with significant flow there may be over 100 nozzles. Larger systems may have thousands or even tens of thousands of nozzles. The spacing of the microfluidic nozzles might be on the order of 0.5 mm to 2 mm, just by example. In some cases, the microfluidic nozzles may even comprise smaller diameter fluid output orifices. Additional or fewer apparatuses than those shown can be utilized. These devices can be linked in parallel or series flow. For example, plenum chambers of a first apparatus can comprise outlet interface on opposing sides of the apparatus from the input/interfaces that can provide a pathway of fluid communication to an adjacent apparatus. That is, the output interface of the first apparatus is connected to an input interface of the adjacent apparatus.

Figure 12:
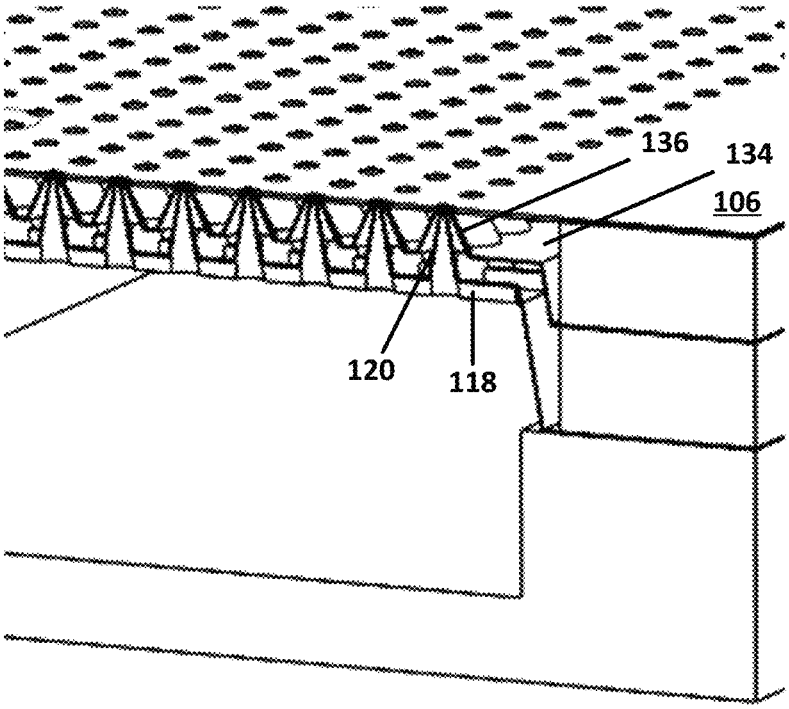
FIGS. 12 and 13 collectively illustrate a cross sectional view of a second micro-fluidic nozzle panel in combination with a first micro-fluidic nozzle panel, where the micro-fluidic nozzles of the first micro-fluidic nozzle panel extend into the micro-fluidic nozzles of the second micro-fluidic nozzle panel.
Figure 13:
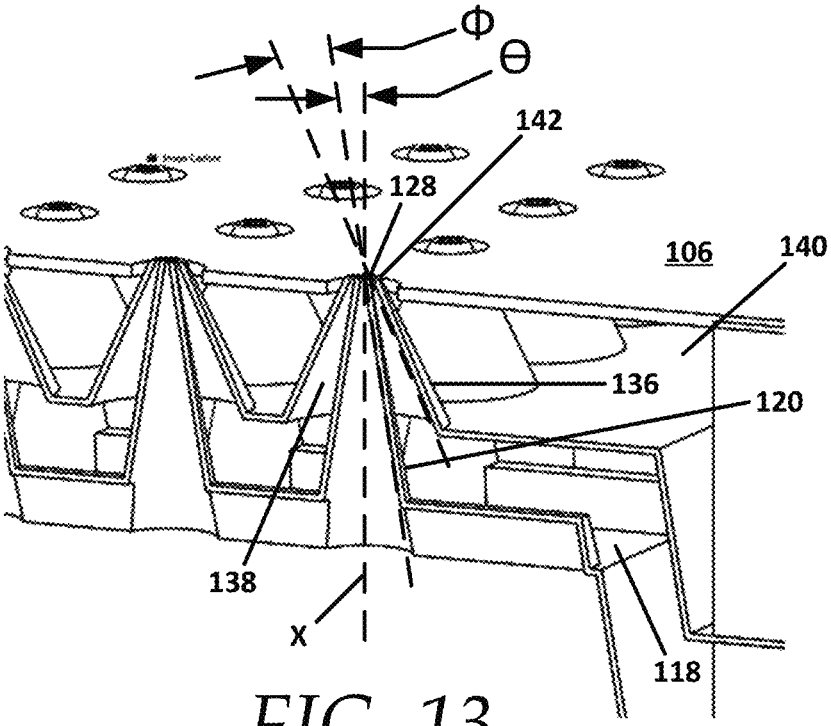

FIGS. 12 and 13 collectively illustrate the use of a second micro-fluidic nozzle panel 134 that is spaced between the orifice plate 106 and the micro-fluidic nozzle panel 118 (also referred to as a first micro-fluidic nozzle panel). The second micro-fluidic nozzle panel 134 comprises a plurality of micro-fluidic nozzles, such as micro-fluidic nozzle 136. The micro-fluidic nozzle 120 of the first micro-fluidic nozzle panel 118 is inserted into the micro-fluidic nozzle 136. The micro-fluidic nozzle 120 is spaced apart from the micro-fluidic nozzle 136 to create conical spacing 138 (e.g., annular conical fluid pathways).

A tertiary plenum chamber 140 is formed between the micro-fluidic nozzle panel 118 and the second micro-fluidic nozzle panel 134. A third input or interface (not shown) provides a pathway or inlet for fluid (in some instances a third fluid type) into the tertiary plenum chamber 140. Fluid within the tertiary plenum chamber 140 exits an annular orifice formed by the spacing of the fluid output orifice 128 of the micro-fluidic nozzle 120 and a fluidic output orifice 142 of the micro-fluidic nozzle 136.

In one instance a sidewall of the micro-fluidic nozzle 136 has an angle $\phi$ that is greater relative to a central axis X than an angle $\theta$ of the micro-fluidic nozzle 120, forming a cone within a cone configuration. The fluid exiting the tertiary plenum chamber 140 also has a laminar flow.

To be sure, additional micro-fluidic nozzle panels can be incorporated as desired.

Figure 14:
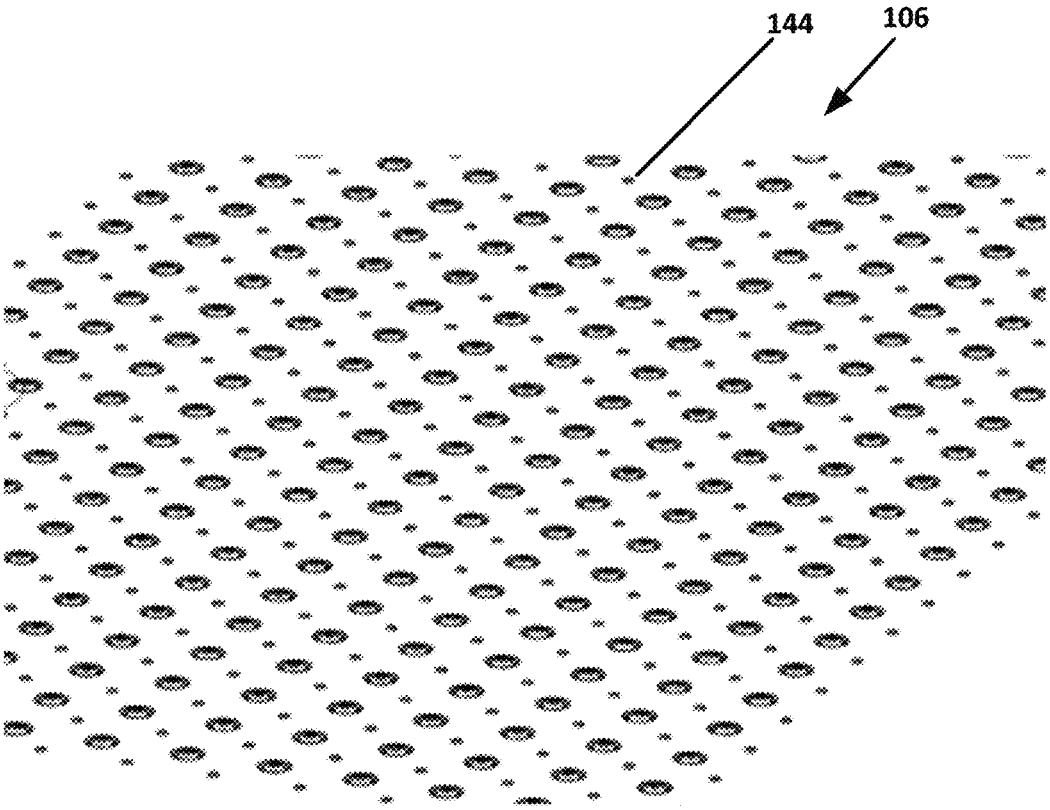
FIG. 14 illustrates the micro-fluidic nozzle panel with ventilation holes.

FIG. 14 illustrates the orifice plate 106 with vent holes 144 that allow a portion of the fluid within the riser plenum chamber 114 to escape without passing through the plurality of micro-fluidic nozzles of the riser plenum chamber 114.

Figure 15:
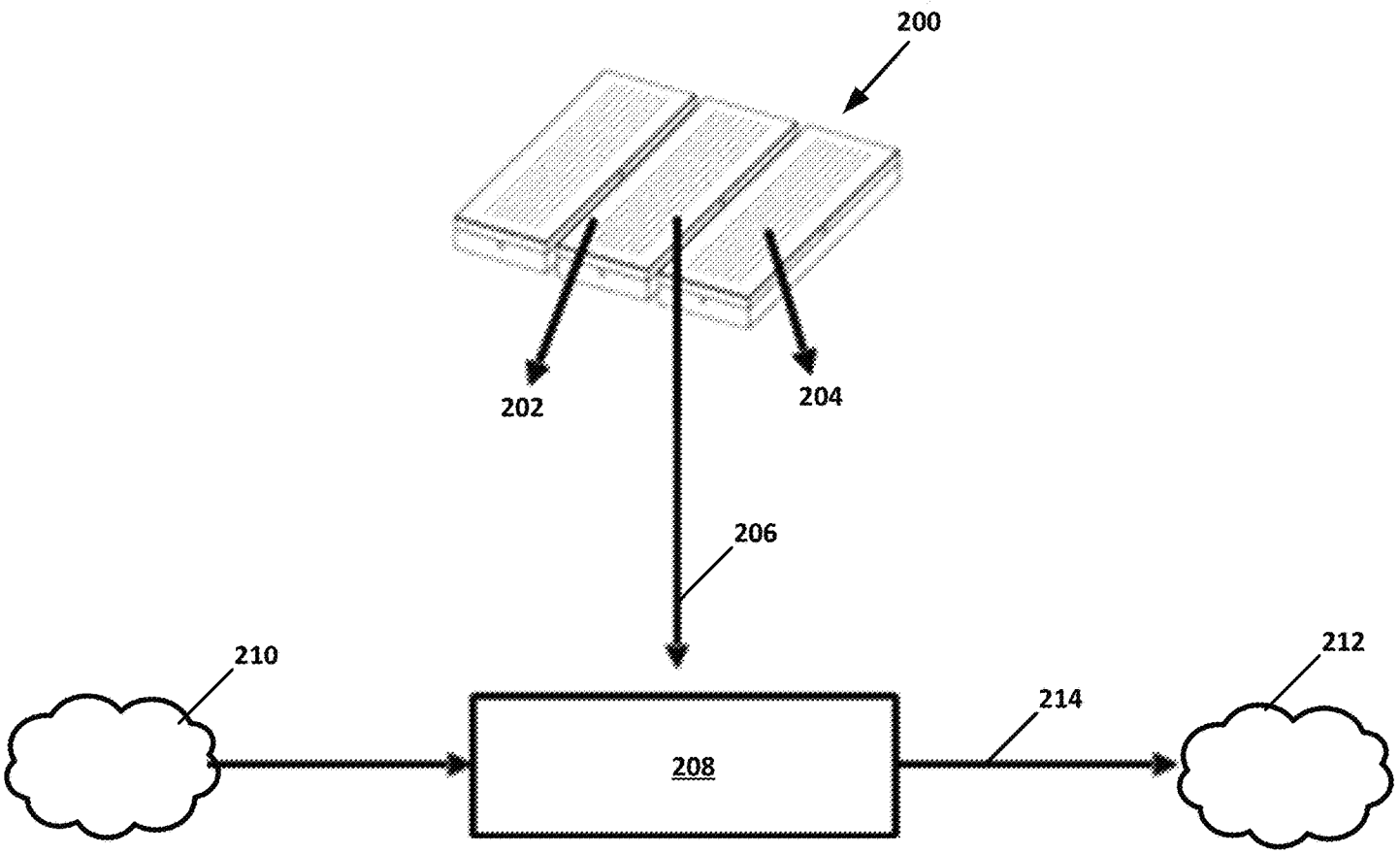
FIG. 15 illustrates the micro-fluidic nozzle apparatus in combination with a tertiary mixing device.

FIG. 15 illustrates an array 200 of apparatuses supplied with a liquid as a primary fluid and a gas as a secondary fluid. Gas escapes the array 200 to the ambient environment in paths 202 and 204, while particles of primary fluid 206 are transferred through laminar flow to a mixing area 208. A tertiary fluid 210, such as a liquid is input in to mixing area 208. The mixing area 208 outputs a mixture 212 of the primary fluid and the tertiary liquid in flow 214. This mixing are 208 could include, for example, a tray or other container of liquid having one or more inlets and one or more outlets.

Figure 16:
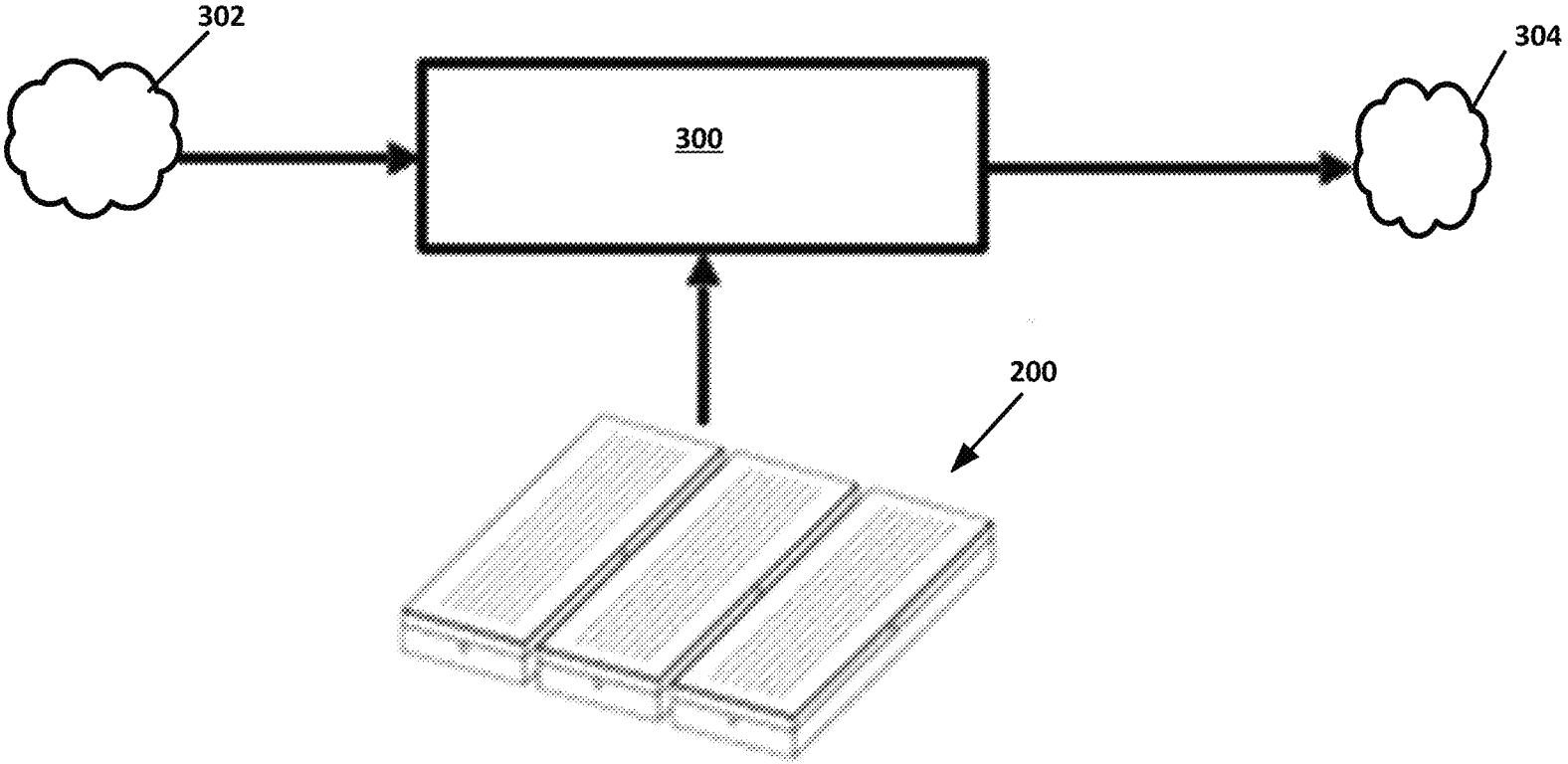
FIG. 16 illustrates the micro-fluidic nozzle apparatus in combination with a reservoir that receives atomized fluid from the micro-fluidic nozzle apparatus.

FIG. 16 illustrates an array 200 of apparatuses supplied with a liquid as a primary fluid and a gas as a secondary fluid. Nozzles of the array 200 inject atomized fluid into a reservoir 300. Mixing of the atomized fluid with a tertiary fluid 302 can occur within the reservoir 300. The array might be located at the bottom of the tray (reservoir 300).

Figure 17:
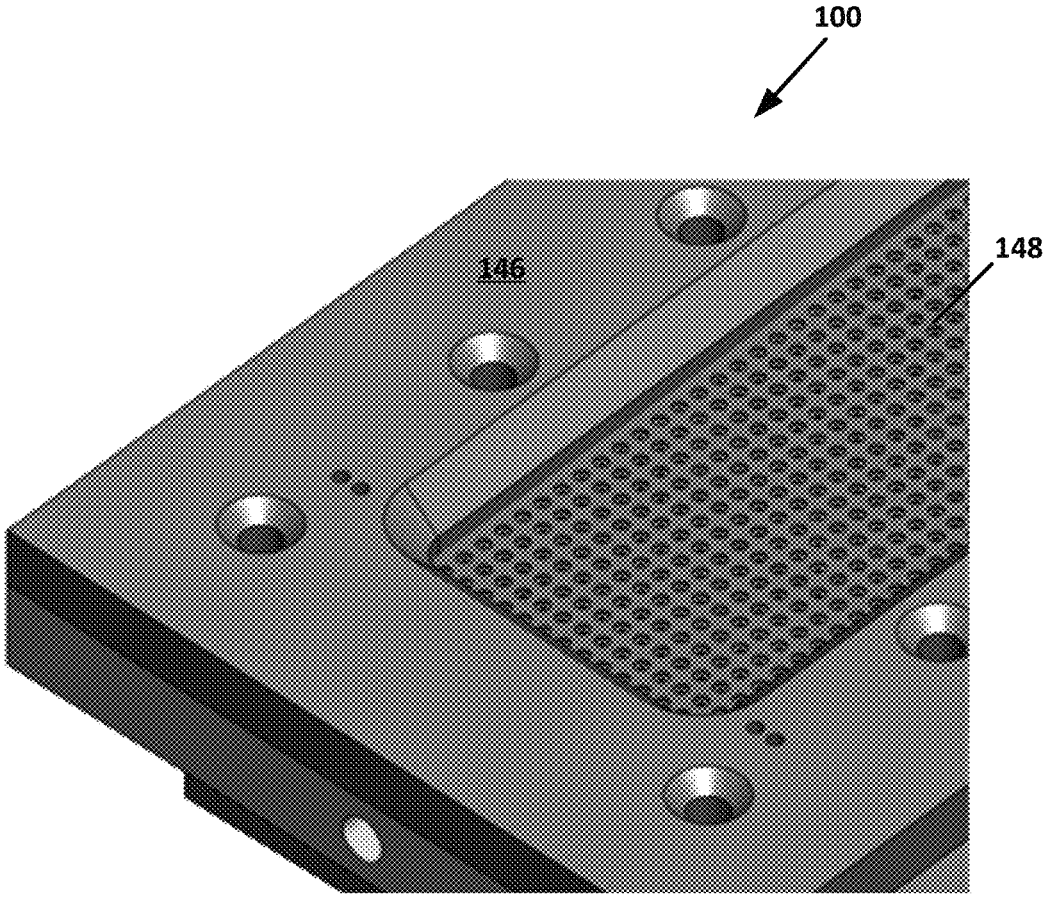
FIG. 17 is a perspective view of a micro-fluidic nozzle apparatus having a reinforcing plate.

FIG. 17 illustrates a reinforcing plate 146 that is secured to the orifice plate 106. The reinforcing plate 146 comprises an opening 148. The plurality of micro-fluidic nozzles extending through the orifice plate 106 are located within a periphery of the opening 148. The reinforcement plate 146 is added to compensate for high secondary or primary fluid pressures within the plenum chambers of the apparatus 100.

Figure 18:
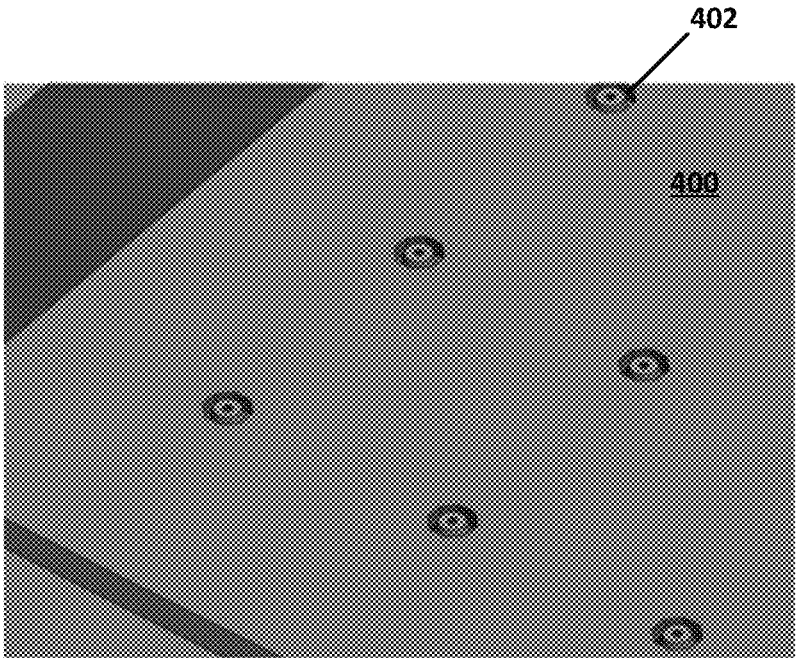
FIG. 18 illustrates an orifice plate with hexagonal shaped apertures.
Figure 19:
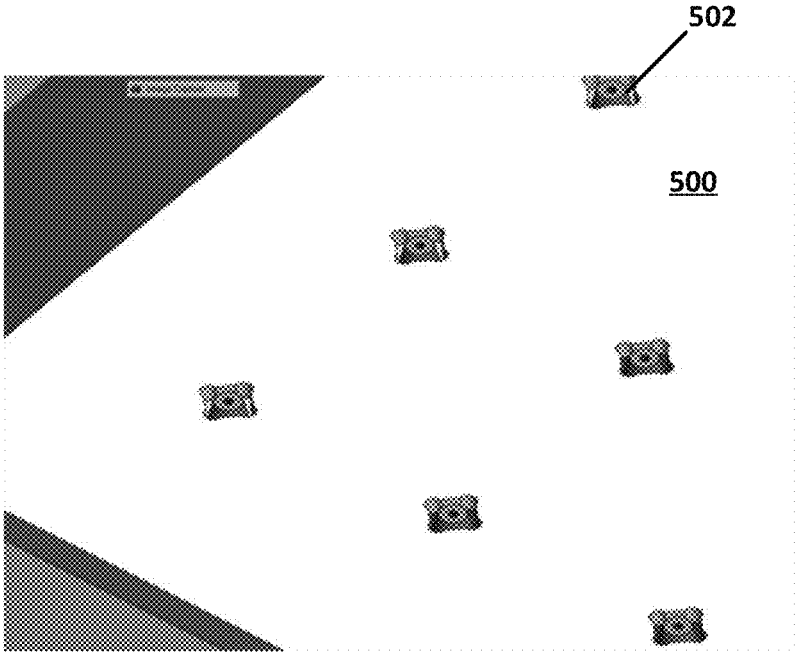
FIG. 19 illustrates an orifice plate with geometric shaped apertures.

FIG. 18 illustrates an orifice plate 400 having hexagonal apertures 402. FIG. 19 illustrates an orifice plate 500 having geometric apertures 502. These orifice plates can be applied onto a micro-fluidic nozzle panel of the present disclosure. It will be understood that the nozzle outlets may comprise geometric shapes as illustrated by the geometric apertures 502 of the orifice plate 500. The geometric apertures 502 of the orifice plate 500 may be substantially circular in shape. In some embodiments, the geometric apertures 502 can include a geometric shape other than circular and the nozzle outlets may also comprise a geometric shape that is other than circular as well. Thus, the shapes of the nozzle outlets and the apertures of the orifice plate 500 can vary widely although the shapes selected should allow for laminar flow through the apparatus.

Figure 20:
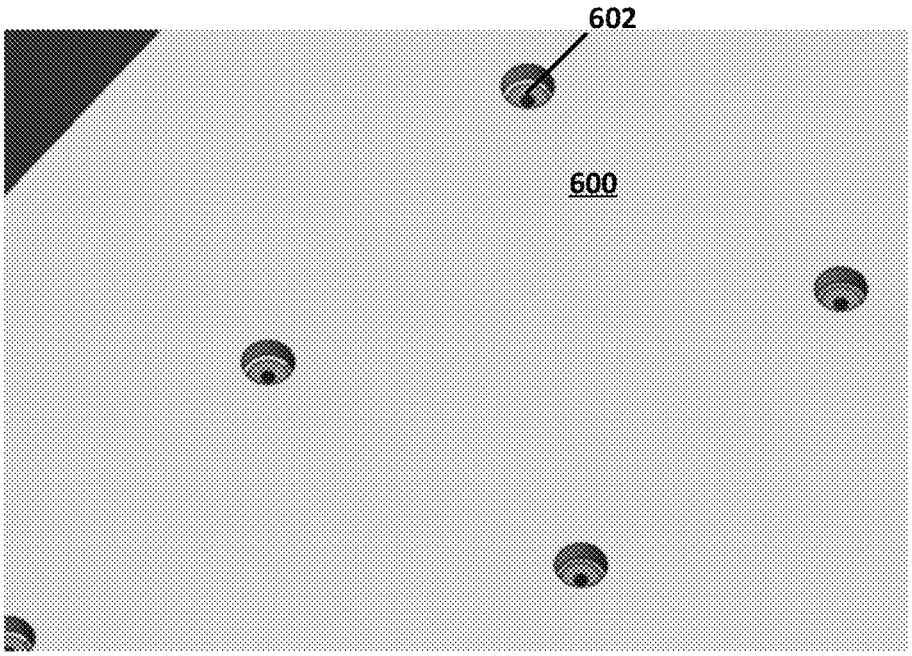
FIGS. 20 and 21 collectively illustrate an orifice plate with circular apertures which have a diameter that is smaller than a diameter of the fluid output orifices of the micro-fluidic nozzles.
Figure 21:
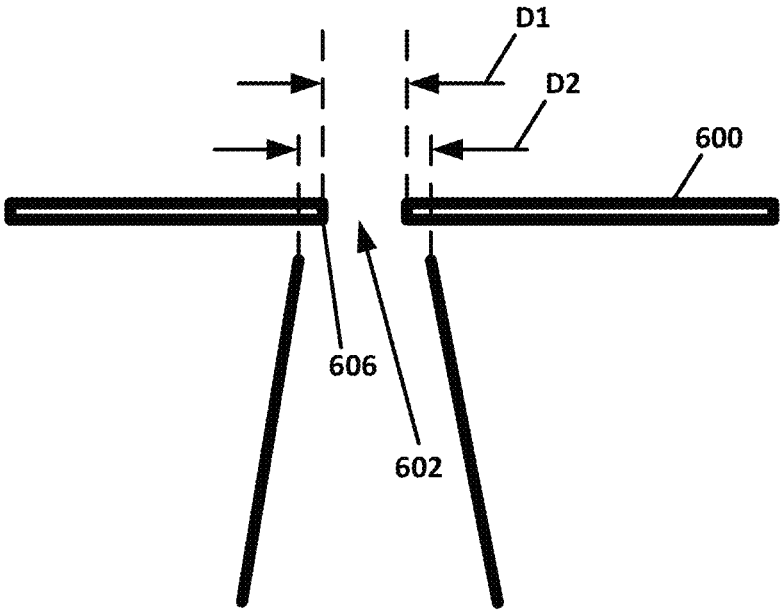

FIGS. 20 and 21 collectively illustrate an orifice plate 600 that comprises apertures 602 that have a diameter D1 that is smaller than a diameter D2 of micro-fluidic nozzles 604 disposed below the apertures 602. In some embodiments, a sidewall 606 of the aperture 602 can be shaped to promote laminar flow such as beveling or rounding.

Gravity can be used to augment the atomization process. It could be used to create force on selected fluids and or particles as they are atomized.

An electric field can be used to augment the atomization process, in some embodiments. The apparatus can also be engineered to apply a charge to the particles or fluid being atomized. This charge can be used to drive them to another charged surface. An example would be when paint is atomized and applied to a surface. In one embodiment, the atomization nozzles can be charged with an electric current. When droplets are output from the atomization nozzles the charge is transferred to the droplets. A target surface, such as a vehicle, carries an opposing charge to that of the droplets. Thus, the droplets are attracted to the oppositely charge target surface.

Figure 22:
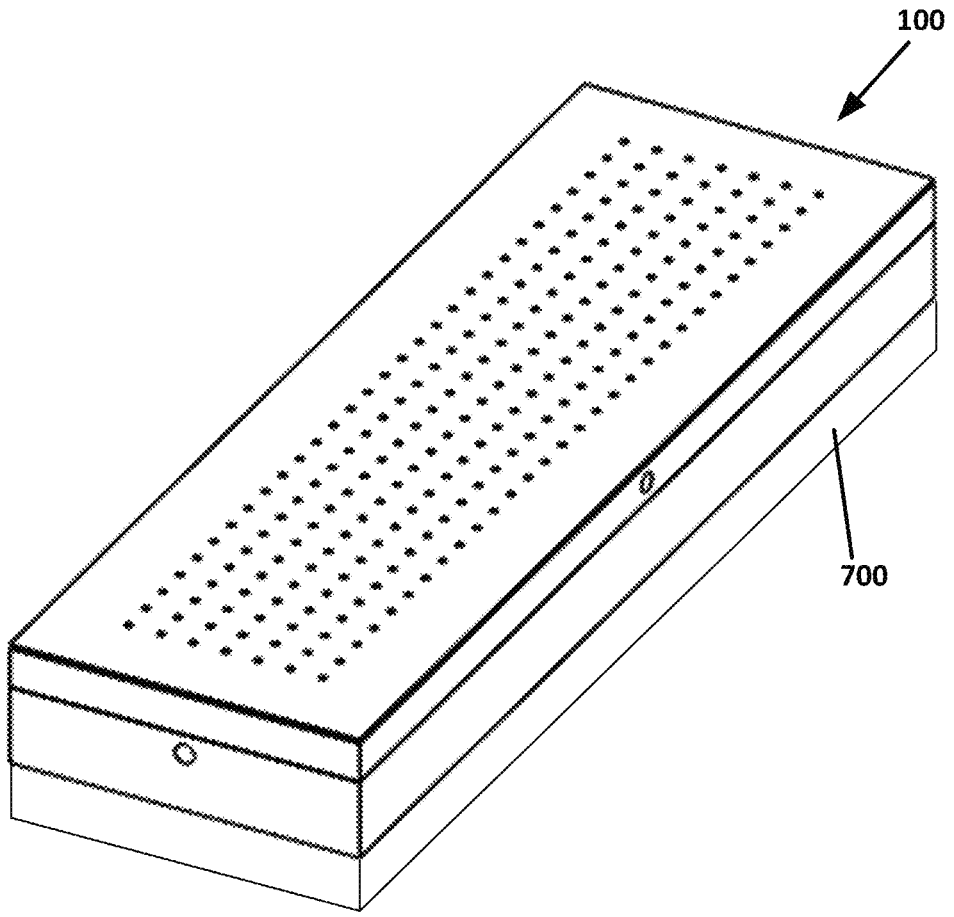
FIG. 22 is a perspective view of the micro-fluidic nozzle apparatus comprising an ultrasonic vibration assembly.

Vibration can also be used to augment the release the removal of droplets from the atomization nozzles. In FIG. 22, the apparatus 100 can comprise a vibration assembly 700 that applies ultrasonic vibration to the base 102 and/or other components of the apparatus 100. Examples of vibration assemblies include, but are not limited to those systems and methods used in inkjet printing devices.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Bolt") may be interchangeably used with its non-capitalized version (e.g., "bolt"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted at the outset that the terms "coupled," "connected", "connecting," "mechanically connected," etc., are used interchangeably herein to generally refer to the condition of being mechanically/physically connected. If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

The terminology used herein can imply direct or indirect, full or partial, temporary or permanent, immediate or delayed, synchronous or asynchronous, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, extrusion, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

Additionally, components described as being "first" or "second" can be interchanged with one another in their respective numbering unless clearly contradicted by the teachings herein.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A micro-fluidic nozzle apparatus, comprising:

a base comprising a sidewall that forms a lower plenum chamber, and a micro-fluidic nozzle panel disposed above the base to enclose the lower plenum chamber, the micro-fluidic nozzle panel comprising a plurality of micro-fluidic nozzles, each of the plurality of micro-fluidic nozzles comprising a fluid output orifice for outputting a fluid, a spacer plenum riser that is mounted onto a periphery of the micro-fluidic nozzle panel an orifice plate that comprises a plurality of apertures, wherein the orifice plate is placed onto the spacer plenum riser to form a riser plenum chamber the fluid output orifice of each of the plurality of micro-fluidic nozzles extending at least partially through the plurality of apertures.

2. The apparatus according to claim 1, wherein the plurality of micro-fluidic nozzles and the plurality of apertures form annular rings.

3. The apparatus according to claim 2, wherein when a second fluid is introduced into the riser plenum chamber, the second fluid passes through the annular rings.

4. The apparatus according to claim 3, wherein the fluid comprises a liquid and the second fluid comprises any of a liquid and a gas.

5. The apparatus according to claim 3, wherein the second fluid has a temperature selected such that all or a portion of the fluid will evaporate.

6. The apparatus according to claim 3, wherein the second fluid has a temperature selected such that all or a portion of the fluid will solidify.

7. The apparatus according to claim 1, wherein the plurality of micro-fluidic nozzles is located below the plurality of apertures, the plurality of micro-fluidic nozzles each having a diameter that is smaller than a diameter of the fluid output orifice of the plurality of micro-fluidic nozzles.

8. A micro-fluidic nozzle apparatus, comprising:

a base comprising a sidewall that forms a lower plenum chamber;

a first micro-fluidic nozzle panel disposed above the base to enclose the lower plenum chamber, the first micro-fluidic nozzle panel comprising a first plurality of conical micro-fluidic nozzles, each of the first plurality of conical micro-fluidic nozzles comprising a fluid output orifice for outputting a fluid;

a first spacer plenum riser that surrounds around a periphery of the first micro-fluidic nozzle panel;

an orifice plate that comprises a plurality of apertures that align with the first plurality of conical micro-fluidic nozzles, the orifice plate mounted to the spacer plenum riser to form a riser plenum chamber; and a second micro-fluidic nozzle panel comprising a second plurality of conical micro-fluidic nozzles, the second micro-fluidic nozzle panel being located between the first micro-fluidic nozzle panel and the orifice plate, wherein the second plurality of conical micro-fluidic nozzles cover at least a portion of the first plurality of conical micro-fluidic nozzles.

9. The apparatus according to claim 8, wherein the second plurality of conical micro-fluidic nozzles are spaced apart from the first plurality of conical micro-fluidic nozzles to form annular conical fluid pathways.

10. The apparatus according to claim 9, further comprising a second spacer plenum riser that surrounds around a periphery of the second micro-fluidic nozzle panel.

* * * * *